US008087901B2

(12) United States Patent
Maier

(10) Patent No.: US 8,087,901 B2
(45) Date of Patent: Jan. 3, 2012

(54) FLUID CHANNELING DEVICE FOR BACK-TO-BACK COMPRESSORS

(75) Inventor: William C. Maier, Almond, NY (US)

(73) Assignee: Dresser-Rand Company, Olean, NY (US)

( * ) Notice: Subject to any disclaimer, the term of this patent is extended or adjusted under 35 U.S.C. 154(b) by 505 days.

(21) Appl. No.: 12/407,962

(22) Filed: Mar. 20, 2009

(65) Prior Publication Data

US 2010/0239437 A1 Sep. 23, 2010

(51) Int. Cl.
*F04B 3/00* (2006.01)

(52) U.S. Cl. ..... 417/245; 417/247; 417/250

(58) Field of Classification Search ..... 417/245, 417/425

See application file for complete search history.

(56) References Cited

U.S. PATENT DOCUMENTS

| | | | |
|---|---|---|---|
| 815,812 | A | 3/1906 | Gow |
| 1,057,613 | A | 4/1913 | Baldwin |
| 1,061,656 | A | 5/1913 | Black |
| 1,480,775 | A | 1/1924 | Marien |
| 1,622,768 | A | 3/1927 | Cook et al. |
| 1,642,454 | A | 9/1927 | Malmstrom |
| 2,006,244 | A | 6/1935 | Kopsa |
| 2,300,766 | A | 11/1942 | Baumann |
| 2,328,031 | A | 8/1943 | Risley |
| 2,345,437 | A | 3/1944 | Tinker |
| 2,602,462 | A | 7/1952 | Barrett |
| 2,811,303 | A | 10/1957 | Ault et al. |
| 2,836,117 | A | 5/1958 | Lankford |
| 2,868,565 | A | 1/1959 | Suderow |
| 2,897,917 | A | 8/1959 | Hunter |
| 2,932,360 | A | 4/1960 | Hungate |
| 2,954,841 | A | 10/1960 | Reistle |
| 3,044,657 | A | 7/1962 | Horton |
| 3,191,364 | A | 6/1965 | Sylvan |
| 3,198,214 | A | 8/1965 | Lorenz |
| 3,204,696 | A | 9/1965 | De Priester et al. |
| 3,213,794 | A | 10/1965 | Adams |
| 3,220,245 | A | 11/1965 | Van Winkle |
| 3,273,325 | A | 9/1966 | Gerhold |
| 3,352,577 | A | 11/1967 | Medney |
| 3,395,511 | A | 8/1968 | Akerman |
| 3,402,434 | A | 9/1968 | Swearingen |
| 3,431,747 | A | 3/1969 | Hasheimi et al. |

(Continued)

FOREIGN PATENT DOCUMENTS

| | | |
|---|---|---|
| CA | 2647511 | 10/2007 |

(Continued)

OTHER PUBLICATIONS

PCT/US2007/008149 International Preliminary Report on Patentability dated Sep. 30, 2008.

(Continued)

*Primary Examiner* — Bumsuk Won
*Assistant Examiner* — Brenitra Lee
(74) *Attorney, Agent, or Firm* — Edmonds & Nolte, PC

(57) ABSTRACT

A fluid channeling device including a channeling body, an axial transfer channel, and a radial outlet channel. The channeling body includes first and second annular body sections spaced axially apart and a tubular body section extending between the first and second body sections. The axial transfer channel is defined axially through the channeling body, and is configured to fluidly couple a first compression assembly with a second compression assembly. The radial outlet channel is defined radially through the channeling body and is configured to fluidly couple the second compression assembly with an outlet.

6 Claims, 6 Drawing Sheets

U.S. PATENT DOCUMENTS

| | | | |
|---|---|---|---|
| 3,454,163 | A | 7/1969 | Read |
| 3,487,432 | A | 12/1969 | Jenson |
| 3,490,209 | A | 1/1970 | Fernandes et al. |
| 3,500,614 | A | 3/1970 | Soo |
| 3,578,342 | A | 5/1971 | Satterthwaite et al. |
| 3,628,812 | A | 12/1971 | Larraide et al. |
| 3,672,733 | A | 6/1972 | Arsenius et al. |
| 3,814,486 | A | 6/1974 | Schurger |
| 3,829,179 | A | 8/1974 | Kurita et al. |
| 3,915,673 | A | 10/1975 | Tamai et al. |
| 3,975,123 | A | 8/1976 | Schibbye |
| 4,033,647 | A | 7/1977 | Beavers |
| 4,059,364 | A | 11/1977 | Anderson et al. |
| 4,078,809 | A | 3/1978 | Garrick et al. |
| 4,087,261 | A | 5/1978 | Hays |
| 4,103,899 | A | 8/1978 | Turner |
| 4,112,687 | A | 9/1978 | Dixon |
| 4,117,359 | A | 9/1978 | Wehde |
| 4,135,542 | A | 1/1979 | Chisholm |
| 4,141,283 | A | 2/1979 | Swanson et al. |
| 4,146,261 | A | 3/1979 | Edmaier et al. |
| 4,165,622 | A | 8/1979 | Brown, Jr. |
| 4,174,925 | A | 11/1979 | Pfenning et al. |
| 4,182,480 | A | 1/1980 | Theyse et al. |
| 4,197,990 | A | 4/1980 | Carberg et al. |
| 4,205,927 | A | 6/1980 | Simmons |
| 4,227,373 | A | 10/1980 | Amend et al. |
| 4,258,551 | A | 3/1981 | Ritzi |
| 4,259,045 | A | 3/1981 | Teruyama |
| 4,278,200 | A | 7/1981 | Gunnewig |
| 4,298,311 | A | 11/1981 | Ritzi |
| 4,333,748 | A | 6/1982 | Erickson |
| 4,334,592 | A | 6/1982 | Fair |
| 4,336,693 | A | 6/1982 | Hays et al. |
| 4,339,923 | A | 7/1982 | Hays et al. |
| 4,347,900 | A | 9/1982 | Barrington |
| 4,363,608 | A | 12/1982 | Mulders |
| 4,374,583 | A | 2/1983 | Barrington |
| 4,375,975 | A | 3/1983 | McNicholas |
| 4,382,804 | A | 5/1983 | Mellor |
| 4,384,724 | A | 5/1983 | Derman et al. |
| 4,391,102 | A | 7/1983 | Studhalter et al. |
| 4,396,361 | A | 8/1983 | Fraser |
| 4,432,470 | A | 2/1984 | Sopha |
| 4,438,638 | A | 3/1984 | Hays et al. |
| 4,441,322 | A | 4/1984 | Ritzi |
| 4,442,925 | A | 4/1984 | Fukushima et al. |
| 4,453,893 | A | 6/1984 | Hutmaker |
| 4,463,567 | A | 8/1984 | Amend et al. |
| 4,468,234 | A | 8/1984 | McNicholas |
| 4,471,795 | A | 9/1984 | Linhardt |
| 4,477,223 | A | 10/1984 | Giroux |
| 4,502,839 | A | 3/1985 | Maddox et al. |
| 4,511,309 | A | 4/1985 | Maddox |
| 4,531,888 | A | 7/1985 | Buchelt |
| 4,536,134 | A | 8/1985 | Huiber |
| 4,541,531 | A | 9/1985 | Brule |
| 4,541,607 | A | 9/1985 | Hotger |
| 4,573,527 | A | 3/1986 | McDonough |
| 4,574,815 | A | 3/1986 | West et al. |
| 4,648,806 | A | 3/1987 | Alexander |
| 4,687,017 | A | 8/1987 | Danko et al. |
| 4,737,081 | A | 4/1988 | Nakajima et al. |
| 4,752,185 | A | 6/1988 | Butler et al. |
| 4,807,664 | A | 2/1989 | Wilson et al. |
| 4,813,495 | A | 3/1989 | Leach |
| 4,821,737 | A | 4/1989 | Nelson |
| 4,826,403 | A | 5/1989 | Catlow |
| 4,830,331 | A | 5/1989 | Vindum |
| 4,832,709 | A | 5/1989 | Nagyszalanczy |
| 4,904,284 | A | 2/1990 | Hanabusa |
| 4,984,830 | A | 1/1991 | Saunders |
| 5,007,328 | A | 4/1991 | Otterman |
| 5,024,585 | A | 6/1991 | Kralovec |
| 5,043,617 | A | 8/1991 | Rostron |
| 5,044,701 | A | 9/1991 | Watanabe et al. |
| 5,045,046 | A | 9/1991 | Bond |
| 5,054,995 | A | 10/1991 | Kaseley et al. |
| 5,064,452 | A | 11/1991 | Yano et al. |
| 5,080,137 | A | 1/1992 | Adams |
| 5,190,440 | A | 3/1993 | Maier et al. |
| 5,202,024 | A | 4/1993 | Andersson et al. |
| 5,202,026 | A | 4/1993 | Lema |
| 5,203,891 | A | 4/1993 | Lema |
| 5,207,810 | A | 5/1993 | Sheth |
| 5,211,427 | A | 5/1993 | Washizu |
| 5,246,346 | A | 9/1993 | Schiesser |
| 5,285,123 | A | 2/1994 | Kataoka et al. |
| 5,306,051 | A | 4/1994 | Loker et al. |
| 5,337,779 | A | 8/1994 | Fukuhara |
| 5,378,121 | A | 1/1995 | Hackett |
| 5,385,446 | A | 1/1995 | Hays |
| 5,421,708 | A | 6/1995 | Utter |
| 5,443,581 | A | 8/1995 | Malone |
| 5,484,521 | A | 1/1996 | Kramer |
| 5,496,394 | A | 3/1996 | Nied |
| 5,500,039 | A | 3/1996 | Mori et al. |
| 5,525,034 | A | 6/1996 | Hays |
| 5,525,146 | A | 6/1996 | Straub |
| 5,531,811 | A | 7/1996 | Kloberdanz |
| 5,538,259 | A | 7/1996 | Uhrner et al. |
| 5,542,831 | A | 8/1996 | Scarfone |
| 5,575,309 | A | 11/1996 | Connell |
| 5,585,000 | A | 12/1996 | Sassi |
| 5,605,172 | A | 2/1997 | Schubert et al. |
| 5,628,623 | A | 5/1997 | Skaggs |
| 5,634,492 | A | 6/1997 | Steinruck et al. |
| 5,640,472 | A | 6/1997 | Meinzer et al. |
| 5,641,280 | A | 6/1997 | Timuska |
| 5,653,347 | A | 8/1997 | Larsson |
| 5,664,420 | A | 9/1997 | Hays |
| 5,682,759 | A | 11/1997 | Hays |
| 5,683,235 | A | 11/1997 | Welch |
| 5,685,691 | A | 11/1997 | Hays |
| 5,687,249 | A | 11/1997 | Kato |
| 5,693,125 | A | 12/1997 | Dean |
| 5,703,424 | A | 12/1997 | Dorman |
| 5,709,528 | A | 1/1998 | Hablanian |
| 5,713,720 | A | 2/1998 | Barhoum |
| 5,720,799 | A | 2/1998 | Hays |
| 5,750,040 | A | 5/1998 | Hays |
| 5,775,882 | A | 7/1998 | Kiyokawa et al. |
| 5,779,619 | A | 7/1998 | Borgstrom et al. |
| 5,795,135 | A | 8/1998 | Nyilas et al. |
| 5,800,092 | A | 9/1998 | Nill et al. |
| 5,848,616 | A | 12/1998 | Vogel et al. |
| 5,850,857 | A | 12/1998 | Simpson |
| 5,853,585 | A | 12/1998 | Nesseth |
| 5,863,023 | A | 1/1999 | Evans et al. |
| 5,899,435 | A | 5/1999 | Mitsch et al. |
| 5,935,053 | A | 8/1999 | Strid |
| 5,938,803 | A | 8/1999 | Dries |
| 5,938,819 | A | 8/1999 | Seery |
| 5,946,915 | A | 9/1999 | Hays |
| 5,951,066 | A | 9/1999 | Lane et al. |
| 5,965,022 | A | 10/1999 | Gould |
| 5,967,746 | A | 10/1999 | Hagi et al. |
| 5,971,702 | A | 10/1999 | Afton et al. |
| 5,971,907 | A | 10/1999 | Johannemann et al. |
| 5,980,218 | A | 11/1999 | Takahashi et al. |
| 5,988,524 | A | 11/1999 | Odajima et al. |
| 6,035,934 | A | 3/2000 | Stevenson et al. |
| 6,059,539 | A | 5/2000 | Nyilas et al. |
| 6,068,447 | A | 5/2000 | Foege |
| 6,090,174 | A | 7/2000 | Douma et al. |
| 6,090,299 | A | 7/2000 | Hays et al. |
| 6,113,675 | A | 9/2000 | Branstetter |
| 6,122,915 | A | 9/2000 | Hays |
| 6,123,363 | A | 9/2000 | Burgard et al. |
| 6,145,844 | A | 11/2000 | Waggott |
| 6,149,825 | A | 11/2000 | Gargas |
| 6,151,881 | A | 11/2000 | Ai et al. |
| 6,196,962 | B1 | 3/2001 | Purvey et al. |
| 6,206,202 | B1 | 3/2001 | Galk et al. |
| 6,214,075 | B1 | 4/2001 | Filges et al. |
| 6,217,637 | B1 | 4/2001 | Toney et al. |
| 6,227,379 | B1 | 5/2001 | Nesseth |

6,277,278 B1 8/2001 Conrad et al.
6,312,021 B1 11/2001 Thomas
6,314,738 B1 11/2001 Hays
6,372,006 B1 4/2002 Pregenzer et al.
6,375,437 B1 4/2002 Nolan
6,383,262 B1 5/2002 Marthinsen et al.
6,394,764 B1 5/2002 Samurin
6,398,973 B1 6/2002 Saunders et al.
6,402,465 B1 6/2002 Maier
6,426,010 B1 7/2002 Lecoffre et al.
6,464,469 B1 10/2002 Grob et al.
6,467,988 B1 10/2002 Czachor et al.
6,468,426 B1 10/2002 Klass
6,485,536 B1 11/2002 Masters
6,530,484 B1 3/2003 Bosman
6,530,979 B2 3/2003 Firey
6,531,066 B1 3/2003 Saunders et al.
6,537,035 B2 3/2003 Shumway
6,540,917 B1 4/2003 Rachels et al.
6,547,037 B2 4/2003 Kuzdzal
6,592,654 B2 7/2003 Brown
6,596,046 B2 7/2003 Conrad et al.
6,599,086 B2 7/2003 Soja
6,607,348 B2 8/2003 Jean
6,616,719 B1 9/2003 Sun et al.
6,617,731 B1 9/2003 Goodnick
6,629,825 B2 10/2003 Stickland et al.
6,631,617 B1 10/2003 Dreiman et al.
6,658,986 B2 12/2003 Pitla et al.
6,659,143 B1 12/2003 Taylor et al.
6,669,845 B2 12/2003 Klass
6,688,802 B2 2/2004 Ross et al.
6,707,200 B2 3/2004 Carroll et al.
6,718,955 B1 4/2004 Knight
6,719,830 B2 4/2004 Illingworth et al.
6,764,284 B2 7/2004 Oehman, Jr.
6,776,812 B2 8/2004 Komura et al.
6,802,693 B2 10/2004 Reinfeld et al.
6,802,881 B2 10/2004 Illingworth et al.
6,811,713 B2 11/2004 Arnaud
6,817,846 B2 11/2004 Bennitt
6,837,913 B2 1/2005 Schilling et al.
6,843,836 B2 1/2005 Kitchener
6,878,187 B1 4/2005 Hays et al.
6,893,208 B2 5/2005 Frosini et al.
6,907,933 B2 6/2005 Choi et al.
6,979,358 B2 12/2005 Ekker
7,001,448 B1 2/2006 West
7,013,978 B2 3/2006 Appleford et al.
7,022,150 B2 4/2006 Borgstrom et al.
7,022,153 B2 4/2006 McKenzie
7,025,890 B2 4/2006 Moya
7,033,410 B2 4/2006 Hilpert et al.
7,033,411 B2 4/2006 Carlsson et al.
7,056,363 B2 6/2006 Carlsson et al.
7,063,465 B1 6/2006 Wilkes et al.
7,112,036 B2 9/2006 Lubell et al.
7,131,292 B2 11/2006 Ikegami et al.
7,144,226 B2 12/2006 Pugnet et al.
7,159,723 B2 1/2007 Hilpert et al.
7,160,518 B2 1/2007 Chen et al.
7,169,305 B2 1/2007 Gomez
7,185,447 B2 3/2007 Arbeiter
7,204,241 B2 4/2007 Thompson
7,241,392 B2 7/2007 Maier
7,244,111 B2 7/2007 Suter et al.
7,258,713 B2 8/2007 Eubank et al.
7,270,145 B2 9/2007 Koezler
7,288,202 B2 10/2007 Maier
7,314,560 B2 1/2008 Yoshida et al.
7,323,023 B2 1/2008 Michele et al.
7,328,749 B2 2/2008 Reitz
7,335,313 B2 2/2008 Moya
7,377,110 B2 5/2008 Sheridan et al.
7,381,235 B2 6/2008 Koene et al.
7,396,373 B2 7/2008 Lagerstedt et al.
7,399,412 B2 7/2008 Keuschnigg
7,435,290 B2 10/2008 Lane et al.
7,445,653 B2 11/2008 Trautmann et al.
7,470,299 B2 12/2008 Han et al.
7,473,083 B2 1/2009 Oh et al.
7,479,171 B2 1/2009 Cho et al.
7,494,523 B2 2/2009 Oh et al.
7,501,002 B2 3/2009 Han et al.
7,520,210 B2 4/2009 Theodore, Jr. et al.
7,575,422 B2 8/2009 Bode et al.
7,578,863 B2 8/2009 Becker et al.
7,591,882 B2 9/2009 Harazim
7,594,941 B2 9/2009 Zheng et al.
7,594,942 B2 9/2009 Polderman
7,610,955 B2 11/2009 Irwin, Jr.
7,628,836 B2 12/2009 Baronet et al.
7,637,699 B2 12/2009 Albrecht
7,674,377 B2 3/2010 Crew
7,677,308 B2 3/2010 Kolle
7,708,537 B2 5/2010 Bhatia et al.
7,708,808 B1 5/2010 Heumann
7,744,663 B2 6/2010 Wallace
7,748,079 B2 7/2010 McDowell et al.
7,766,989 B2 8/2010 Lane et al.
7,811,344 B1 10/2010 Duke et al.
7,811,347 B2 10/2010 Carlsson et al.
7,815,415 B2 10/2010 Kanezawa et al.
7,824,458 B2 11/2010 Borgstrom et al.
7,824,459 B2 11/2010 Borgstrom et al.
7,846,228 B1 12/2010 Saaski et al.
2001/0007283 A1 7/2001 Johal et al.
2002/0009361 A1 1/2002 Reichert et al.
2003/0029318 A1 2/2003 Firey
2003/0035718 A1 2/2003 Langston et al.
2003/0136094 A1 7/2003 Illingworth et al.
2004/0007261 A1 1/2004 Cornwell
2004/0170505 A1 9/2004 Lenderink et al.
2005/0173337 A1 8/2005 Costinel
2006/0065609 A1 3/2006 Arthur
2006/0090430 A1 5/2006 Trautman et al.
2006/0096933 A1 5/2006 Maier
2006/0157251 A1 7/2006 Stinessen et al.
2006/0157406 A1 7/2006 Maier
2006/0193728 A1 8/2006 Lindsey et al.
2006/0222515 A1 10/2006 Delmotte et al.
2006/0230933 A1 10/2006 Harazim
2006/0239831 A1 10/2006 Garris, Jr.
2006/0254659 A1 11/2006 Ballot et al.
2006/0275160 A1 12/2006 Leu et al.
2007/0029091 A1 2/2007 Stinessen et al.
2007/0036646 A1 2/2007 Nguyen et al.
2007/0051245 A1 3/2007 Yun
2007/0062374 A1 3/2007 Kolle
2007/0065317 A1 3/2007 Stock
2007/0084340 A1 4/2007 Dou et al.
2007/0140870 A1 6/2007 Fukanuma et al.
2007/0151922 A1 7/2007 Mian
2007/0163215 A1 7/2007 Lagerstadt
2007/0172363 A1 7/2007 Laboube et al.
2007/0196215 A1 8/2007 Frosini et al.
2007/0227969 A1 10/2007 Dehaene et al.
2007/0294986 A1 12/2007 Beetz
2008/0031732 A1 2/2008 Peer et al.
2008/0039732 A9 2/2008 Bowman
2008/0246281 A1 10/2008 Agrawal et al.
2008/0315812 A1 12/2008 Balboul
2009/0013658 A1 1/2009 Borgstrom et al.
2009/0015012 A1 1/2009 Metzler et al.
2009/0025562 A1 1/2009 Hallgren et al.
2009/0025563 A1 1/2009 Borgstrom et al.
2009/0151928 A1 6/2009 Lawson
2009/0159523 A1 6/2009 McCutchen
2009/0169407 A1 7/2009 Yun
2009/0173095 A1 7/2009 Bhatia et al.
2009/0266231 A1 10/2009 Franzen et al.
2009/0304496 A1 12/2009 Maier
2009/0321343 A1 12/2009 Maier
2009/0324391 A1 12/2009 Maier
2010/0007133 A1 1/2010 Maier
2010/0021292 A1 1/2010 Maier et al.
2010/0038309 A1 2/2010 Maier
2010/0043288 A1 2/2010 Wallace

| | | | |
|---|---|---|---|
| 2010/0043364 | A1 | 2/2010 | Curien |
| 2010/0044966 | A1 | 2/2010 | Majot et al. |
| 2010/0072121 | A1 | 3/2010 | Maier |
| 2010/0074768 | A1 | 3/2010 | Maier |
| 2010/0083690 | A1 | 4/2010 | Sato et al. |
| 2010/0090087 | A1 | 4/2010 | Maier |
| 2010/0143172 | A1 | 6/2010 | Sato et al. |
| 2010/0163232 | A1 | 7/2010 | Kolle |
| 2010/0183438 | A1 | 7/2010 | Maier et al. |
| 2010/0239419 | A1 | 9/2010 | Maier et al. |
| 2010/0239437 | A1 | 9/2010 | Maier |
| 2010/0247299 | A1 | 9/2010 | Maier |
| 2010/0257827 | A1 | 10/2010 | Lane et al. |
| 2011/0017307 | A1 | 1/2011 | Kidd et al. |
| 2011/0061536 | A1 | 3/2011 | Maier et al. |

FOREIGN PATENT DOCUMENTS

| | | | |
|---|---|---|---|
| EP | 301285 | | 10/1991 |
| EP | 1582703 | | 10/2005 |
| EP | 2013479 | | 1/2009 |
| EP | 7838631.5 | | 12/2009 |
| GB | 2323639 | | 9/1998 |
| GB | 2337561 | | 11/1999 |
| JP | 54099206 | | 1/1978 |
| JP | 08 068501 | | 3/1996 |
| JP | 8-284961 | A | 11/1996 |
| JP | 2002 242699 | | 8/2002 |
| JP | 2004034017 | A | 2/2004 |
| JP | 3711028 | | 10/2005 |
| JP | 2005291202 | | 10/2005 |
| KR | 2009085521 | | 2/2008 |
| MX | 2008012579 | | 12/2008 |
| WO | 9524563 | | 9/1995 |
| WO | 0117096 | | 3/2001 |
| WO | 2007043889 | | 4/2007 |
| WO | 2007103248 | | 9/2007 |
| WO | 2007120506 | | 10/2007 |
| WO | 2008036221 | | 3/2008 |
| WO | 2008039446 | | 3/2008 |
| WO | 2008039491 | | 4/2008 |
| WO | 2008039731 | | 4/2008 |
| WO | 2008039732 | | 4/2008 |
| WO | 2008039733 | | 4/2008 |
| WO | 2008039734 | | 4/2008 |
| WO | 2008036394 | | 7/2008 |
| WO | 2009111616 | | 9/2009 |
| WO | 2009158252 | | 12/2009 |
| WO | 2009158253 | | 12/2009 |
| WO | 2010083416 | | 7/2010 |
| WO | 2010083427 | | 7/2010 |
| WO | 2010107579 | | 9/2010 |
| WO | 2010110992 | | 9/2010 |
| WO | 2011034764 | | 3/2011 |

OTHER PUBLICATIONS

PCT/US2007/008149 International Search Report and Written Opinion dated Jul. 17, 2008.

PCT/US2007/020101 International Preliminary Report on Patentability dated Apr. 2, 2009.

PCT/US2007/020101 International Search Report dated Apr. 29, 2008.

PCT/US2007/020101 Written Opinion dated Mar. 19, 2009.

PCT/US2007/020471 International Preliminary Report on Patentability dated Apr. 2, 2009.

PCT/US2007/020471 International Search Report and Written Opinion dated Apr. 1, 2008.

PCT/US2007/020659 International Preliminary Report on Patentability dated Mar. 31, 2009.

PCT/US2007/020659 International Search Report and Written Opinion dated Sep. 17, 2008.

PCT/US2007/020768 International Preliminary Report on Patentability dated Mar. 31, 2009.

PCT/US2007/020768 International Search Report and Written Opinion dated Mar. 3, 2008.

PCT/US2007/079348 International Preliminary Report on Patentability dated Mar. 31, 2009.

PCT/US2007/079348 International Search Report dated Apr. 11, 2008.

PCT/US2007/079348 Written Opinion dated Jan. 25, 2008.

PCT/US2007/079349 International Preliminary Report on Patentability dated Mar. 31, 2009.

PCT/US2007/079349 International Search Report and Written Opinion dated Apr. 2, 2008.

PCT/US2007/079350 International Preliminary Report on Patentability dated Mar. 31, 2009.

PCT/US2007/079350 International Search Report dated Jul. 17, 2008.

PCT/US2007/079350 Written Opinion dated Mar. 25, 2009.

PCT/US2007/079352 International Preliminary Report on Patentability dated Mar. 31, 2009.

PCT/US2007/079352 International Search Report and Written Opinion dated Aug. 27, 2008.

PCT/US2009/036142 International Preliminary Report on Patentability dated Sep. 16, 2010.

PCT/US2009/036142 International Search Report dated Jan. 7, 2010.

PCT/US2009/036142 Written Opinion dated May 11, 2009.

PCT/US2009/047662 International Preliminary Report on Patentability dated Jan. 13, 2011.

PCT/US2009/047662 Written Opinion dated Aug. 20, 2009.

PCT/US2010/021199 International Search Report and Written Opinion dated Mar. 22, 2010.

PCT/US2010/021199 International Preliminary Report on Patentability dated Mar. 29, 2011.

PCT/US2010/021218 International Search Report and Written Opinion dated Mar. 23, 2010.

PCT/US2010/021218 International Report on Patentability dated Feb. 2, 2011.

PCT/US2010/025650 International Search Report and Written Opinion dated Apr. 22, 2010.

PCT/US2010/025650 International Report on Patentability dated Mar. 14, 2011.

PCT/US2010/025952 International Search Report and Written Opinion dated Apr. 12, 2010.

PCT/US2010/025952 International Report on Patentability dated Mar. 14, 2011.

PCT/US2009/047667 International Report on Patentability dated Jan. 13, 2011.

PCT/US2009/047667 Written Opinion dated Aug. 7, 2009.

PCT/US2009/047667 International Search Report dated Dec. 30, 2009.

Dresser-Rand, Inc. "High Pressure Air Compressor Model 13NL45," Oct. 28, 1991, 14 pages.

Technical Manual—High Pressure Air Compressor Model 13NL45; Navsea S6220-AT-MMA-010/93236, pp. 3-23 to 3-32, Electric Boat Corporation, Groton, CT 06340, Oct. 28, 1991.

FLUID CHANNELING DEVICE FOR BACK-TO-BACK COMPRESSORS

BACKGROUND

The present invention relates to fluid machinery, and more particularly to fluid channeling components for compressors.

Fluid machinery, such as a centrifugal compressor, generally includes a casing, a rotatable shaft extending through the casing, one or more impellers mounted on the shaft for pressurizing fluid, a driver such as an electric motor, and various supporting components, such as bearings, seals, etc. One type of compressor, referred to as a "back-to-back" compressor, includes two separate compression assemblies, each of which includes one or more impellers arranged in an opposing manner on the same shaft so as to balance thrust induced on each compression section. Fluid being pressurized may pass through a first compression section, then through a second, opposing compression section, and is thereafter directed out of the casing for subsequent use or additional processing. Typically, external piping is required to transfer fluid from the outlet of the first compression assembly to the inlet of the second compression assembly, which requires additional penetrations of the casing for piping inlet(s) and outlet(s) and increases the overall size of the compressor assembly.

SUMMARY

Embodiments of the disclosure may provide an exemplary fluid channeling device for a compressor including a channeling body disposed in an interior chamber of the compressor. The exemplary fluid channeling device also includes axial transfer channels extending axially through channeling body, and configured to fluidly couple an outlet of a first compression assembly of the compressor with an inlet of a second compression assembly of the compressor. The exemplary fluid channeling device also includes radial outlet channels extending radially through the channeling body and configured to fluidly couple an outlet of the second compression assembly with an outlet of a casing of the compressor. Further, the channeling body is configured to prevent intermixing of a fluid between the axial transfer channels and the radial outlet channels, while allowing the fluid to flow therethrough.

Embodiments of the disclosure may further provide an exemplary fluid channeling device including a channeling body, an axial transfer channel, and a radial outlet channel. The channeling body includes first and second annular body sections spaced axially apart and a tubular body section extending between the first and second body sections. The axial transfer channel is defined axially through the channeling body, and is configured to fluidly couple a first compression assembly with a second compression assembly. The radial outlet channel is defined radially through the channeling body and is configured to fluidly couple the second compression assembly with an outlet.

Embodiments of the disclosure may further provide an exemplary compressor including a casing, first and second compression assemblies, and a fluid channeling device. The casing has an interior chamber, a central axis extending through the interior chamber, and an outlet. The first and second compression assemblies are disposed in the interior chamber, and are spaced axially apart along the central axis. Each of the first and second compression assemblies has an inlet, an outlet, and at least one compressor stage. The fluid channeling device includes a channeling body that is disposable within the interior chamber, and axial transfer channels that are configured to fluidly couple the outlet of the first compression assembly with the inlet of the second compression assembly. Further, the fluid channeling device includes radial outlet channels that are configured to fluidly couple the outlet of the second compression assembly with the outlet of the casing.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features is arbitrarily increased or reduced for clarity of discussion.

DETAILED DESCRIPTION

Figure 1:
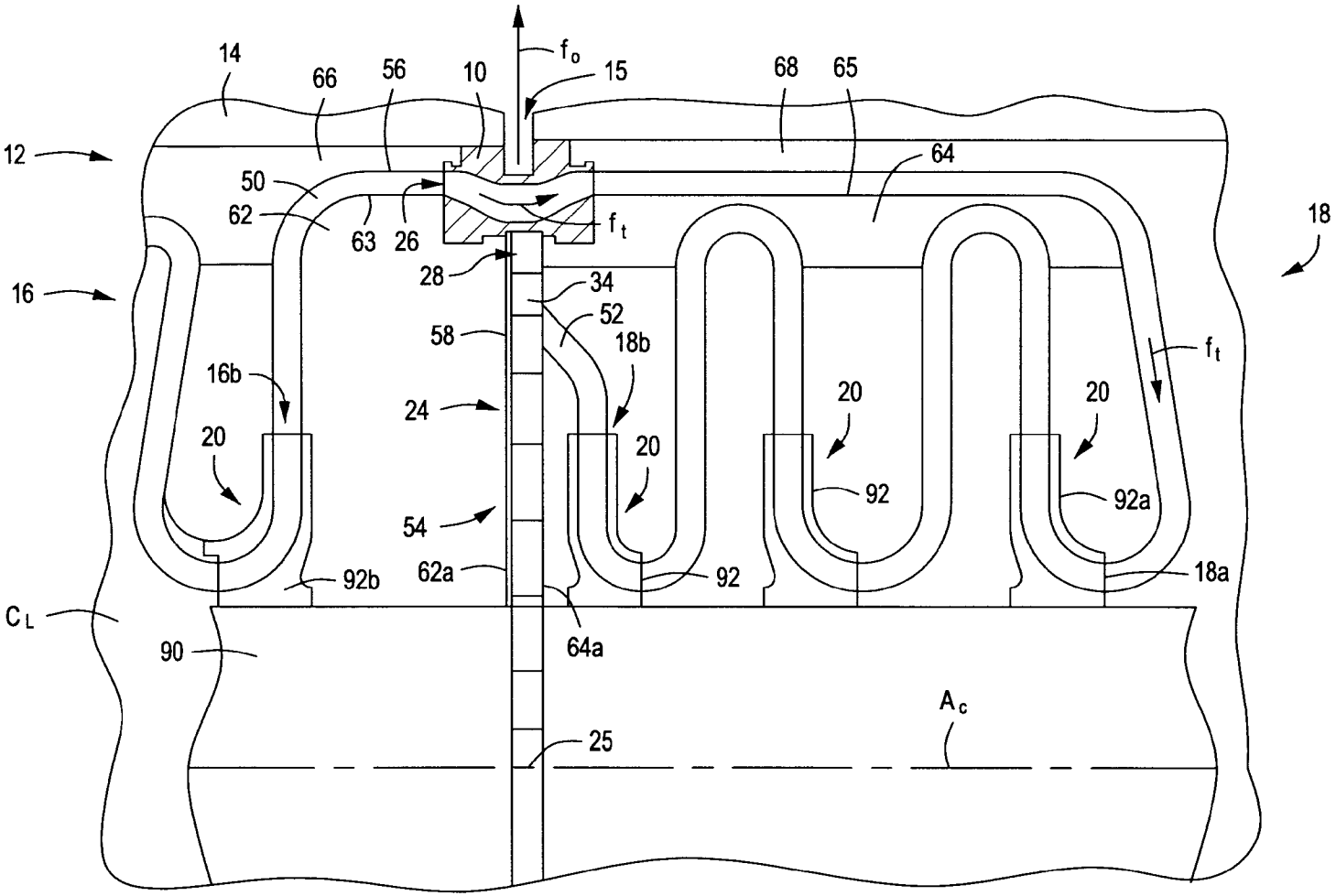
FIG. 1 illustrates a broken-away, axial cross-sectional view of an exemplary embodiment of a compressor, in accordance with the disclosure.

It is to be understood that the following disclosure describes several exemplary embodiments for implementing different features, structures, or functions of the invention. Exemplary embodiments of components, arrangements, and configurations are described below to simplify the present disclosure, however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows includes embodiments in which the first and second features are formed in direct contact, and also includes embodiments in which additional features is formed interposing the first and second features, such that the first and second features may not be in direct contact. Finally, the exemplary embodiments presented below is combined in any combination of ways, i.e., any element from one exemplary embodiment is used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure are exact or approximate values unless otherwise specifically stated. Accordingly, various embodiments of the disclosure may deviate from the numbers, values, and ranges disclosed herein without departing from the intended scope.

Referring now to the drawings in detail, wherein like numbers are used to indicate like elements throughout, there is shown in FIG. 1 an exemplary embodiment of a fluid channeling device 10, shown broken away along the radial middle, for a compressor 12 that includes a casing 14 with an interior chamber $C_C$, a central axis $A_C$ extending through the interior chamber $C_C$, and an outlet 15. First and second compression assemblies 16, 18 may be disposed within the interior chamber $C_C$ so as to be spaced apart along the central axis $A_C$. The first and second compression assemblies 16, 18 may be oriented in a "back-to-back" arrangement, as is know in the art of centrifugal compressors. Each compression assembly 16, 18 has at least one compressor stage 20 and an outlet 16*b*, 18*b*, respectively. The first compression assembly 16 has an inlet (not shown) and the second compression assembly 18 has an inlet 18*a*.

The fluid channeling device 10 includes a channeling body 24, which may be disposable in the interior chamber $C_C$ between the first and second compression assemblies 16, 18. The fluid channeling device 10 may include one or more axial transfer channels 26 and/or one or more radial outlet channels 28. In the illustrated exemplary embodiment, the fluid channeling device 10 has a plurality of axial transfer channels 26, and a plurality of radial outlet channels 28. Each axial transfer channel 26 may extend through the channeling body 24, fluidly coupling the outlet 16*b* of the first compression assembly 16 with the inlet 18*a* of the second compression assembly 18, and each radial outlet channel 28 may extend through the channeling body 24, fluidly coupling the outlet 18*b* of the second compression assembly 18 with the outlet 15 of the casing 14. The channeling body 24 may further have a central axis 25, which may be collinear with the central axis $A_C$.

Figure 2:
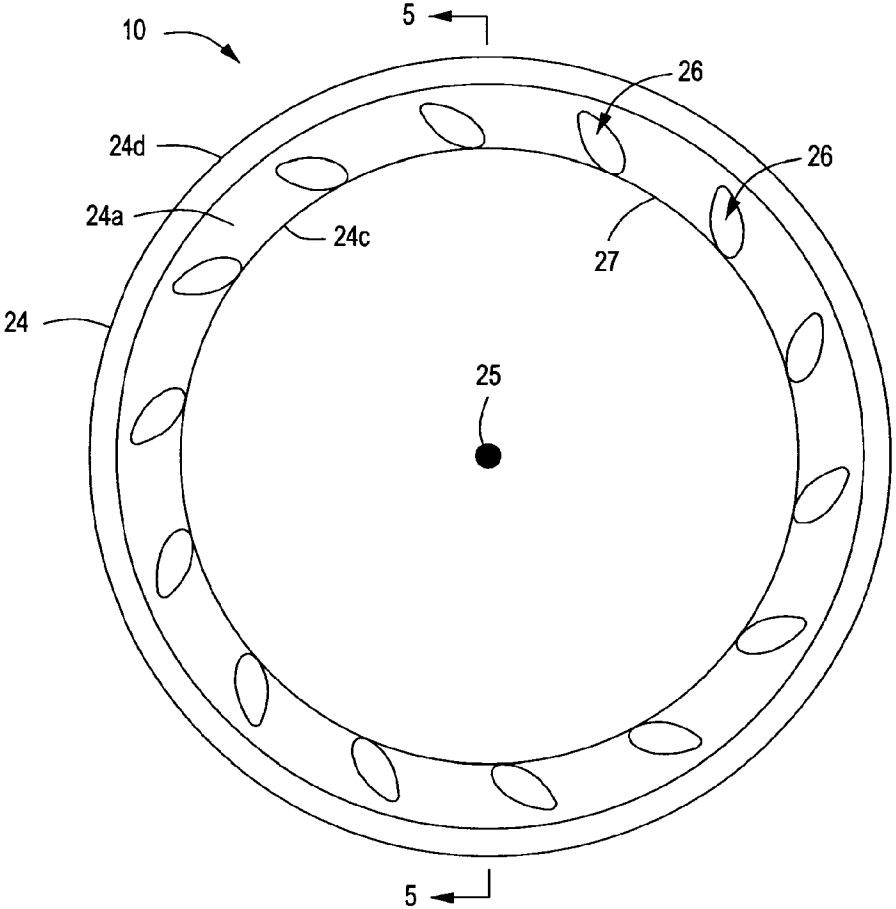
FIG. 2 illustrates a front plain view of an exemplary embodiment of a fluid channeling device in accordance with the disclosure.

FIG. 2 illustrates an exemplary embodiment of the fluid channeling device 10 viewed from the upstream axial perspective (i.e., from the perspective of the first compression assembly 16, as shown in FIG. 1). The channeling body 24 may be generally annular and disposed around the central axis 25. The channeling body 24 has a first axial end 24*a*, which may face the first compression assembly 16 (shown in FIG. 1). The channeling body 24 may also have inner and outer circumferential sides 24*c*, 24*d* disposed around the central axis 25, with the outer circumferential side 24*d* spaced radially apart from the inner circumferential side 24*c*, defining the radial extents of the channeling body 24. The axial transfer channels 26 extend into the channeling body 24, and may extend through it, as described below. Further, the inner circumferential side 24*c* of the channeling body 24 may define a central bore 27, which may extend through the channeling body 24.

Figure 3:
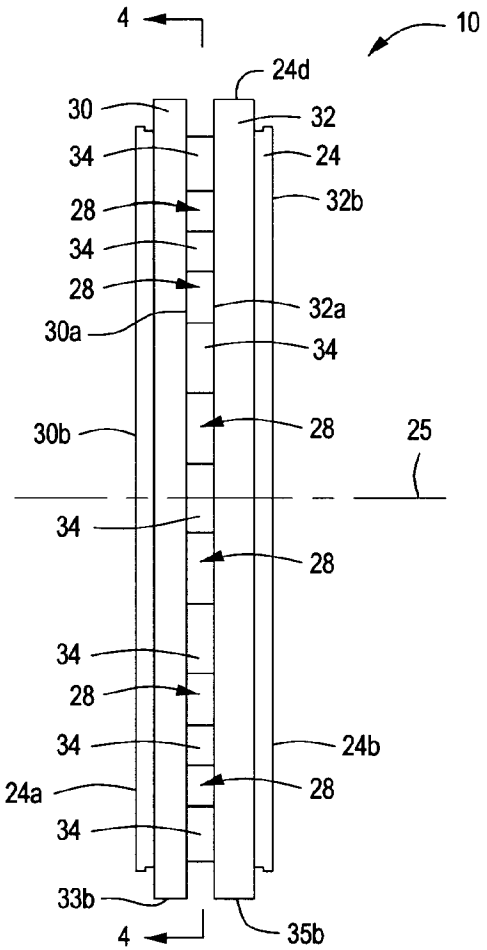
FIG. 3 illustrates a side plain view of an exemplary embodiment of a fluid channeling device in accordance with the disclosure.

FIG. 3 illustrates an exemplary embodiment of the channeling body 24 viewed from the radial perspective (i.e., orthogonal to the previously described axial view). The exemplary channeling body 24 has the first axial end 24*a*, as described with reference to FIG. 2, and also a second axial end 24*b*, which may face the second compression assembly 18 (shown in FIG. 1). Together, the first and second axial ends 24*a*, 24*b* may define the axial extents of the channeling body 24, with the central axis 25 extending through the channeling body 24.

The channeling body 24 may further include first and second annular body sections 30, 32, which are axially aligned and spaced axially apart along the central axis 25. As shown, the outer circumferential side 24*d* may be broken apart between the first and second annular body sections 30, 32, i.e., the outer circumferential side 24*d* may not be continuous, but in other embodiments, it may be continuous. The first and second annular body sections 30, 32 may be generally circular and may have facing inner axial ends 30*a*, 32*a*, respectively, opposing outer axial ends 30*b*, 32*b*, respectively, and outer circumferential surfaces 33*b*, 35*b*, respectively. One or more tubular body sections 34 may extend between and connect the first and second annular body sections 30, 32. In an exemplary embodiment, the channeling body 24 includes a plurality of the tubular body sections 34. The radial outlet channels 28 may extend radially through the channeling body 24, and may be defined radially between, i.e., partitioned by, the tubular body sections 34. More particularly, in an exemplary embodiment, the radial outlet channels 28 may be defined between tubular body sections 34 that are circumferentially adjacent, which may be better appreciated when described below in reference to FIG. 6. Further, the radial transfer channels 28 may be defined axially between the first and second annular body sections 30, 32.

Figure 4:
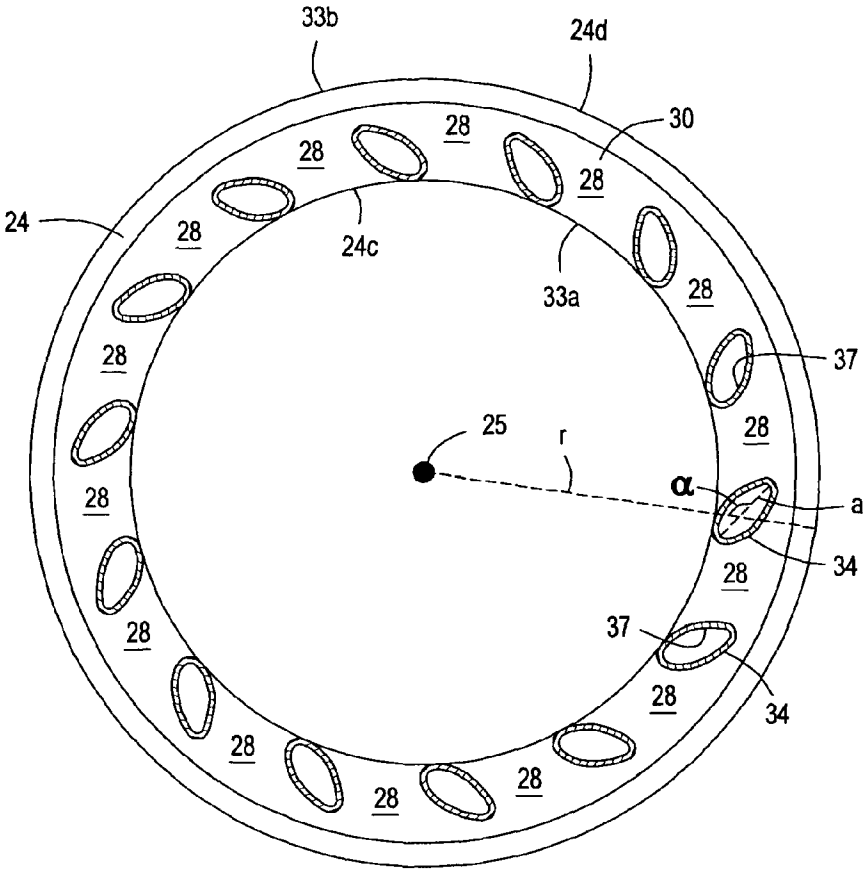
FIG. 4 illustrates a view through line 4-4 of FIG. 3, in accordance with the disclosure.

FIG. 4 illustrates a broken-away view, along line 4-4 of FIG. 3, of the axial middle of the exemplary embodiment of the channeling body 24, viewed toward the first annular body section 30. The reverse view, toward the second annular body section 32, is not illustrated, but may be substantially similar to FIG. 4. As shown, the tubular body sections 34 may be spaced apart circumferentially around the central axis 25. As described with reference to FIG. 3, the radial outlet channels 28 may be defined between circumferentially adjacent tubular body sections 34. Thus, the radial outlet channels 28 may extend radially between the inner circumferential side 24*c* and the outer circumferential side 24*d*, between the circumferentially spaced apart tubular body sections 34.

Further, the tubular body sections 34 may each have a radial cross section that is elongated, and which may form an aerofoil shape. In other embodiments, the cross-section of the tubular body sections 34 may elliptical, wherein the elliptical shape has at least about a 2:1 aspect ratio between the major and minor diameters. Further, the tubular body sections 34 may each have a major axis a. The tubular body sections 34 may each be disposed at an angle $\alpha$ with respect to a radius r drawn to extend radially outwards from the central axis 25. This angle $\alpha$ may vary among the tubular body sections 34, or may be the same throughout. In an exemplary embodiment, the angle $\alpha$ may be chosen to orient the tubular body sections 34 to align with a radial outlet flow $f_o$ (described in detail below) to minimize drag losses.

Figure 5:
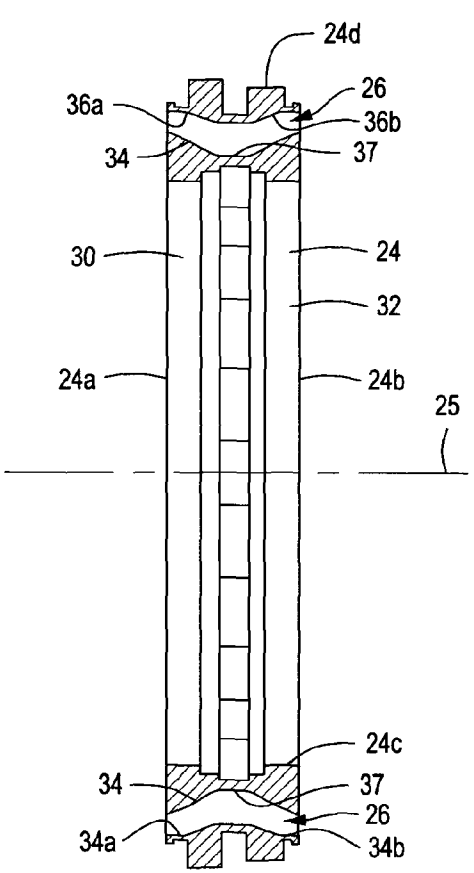
FIG. 5 illustrates a view through line 5-5 of FIG. 2, in accordance with the disclosure.

FIG. 5 illustrates a broken away view, along line 5-5 of FIG. 2, of an exemplary embodiment of the channeling body 24. As shown, each of the tubular body sections 34 may extend between the first and second annular body sections 30, 32, between the inner and outer circumferential sides 24*c*, 24*d*, and may define a central bore 37 therein, providing at least a portion of the axial transfer channels 26. Further, the first annular body section 30 may have first openings 36*a*, and the second annular body section 32 may have second openings 36*b*. It will be appreciated that the first and second openings 36*a*, 36*b* may each be spaced apart circumferentially around the central axis 25, such that they are aligned with the tubular body sections 34.

The tubular body sections 34 may have first and second open ends 34*a*, 34*b*. The first open end 34*a* of each tubular body section 34 may be disposed in, and/or integrally connected with, one of the first openings 36*a*. Likewise, the second open end 34*b* of each tubular body section 34 may be disposed in, and/or integrally formed with, one of the second openings 36*a*. Accordingly, the tubular body sections 34 may each extend between the first and second annular body sections 30, 32, with the tubular body sections 34, and the first and second openings 36*a*, 36*b*, circumferentially spaced apart around the central axis 35, and axially aligned. The axial transfer channels 26 may thereby extend axially through the channeling body 24, beginning at the first axial end 24*a*, extending through the first annular section 30, via the first openings 36*a*, through the central bore 37 of each of the tubular body sections 34, through the second annular body section 32 via the second openings 36*b*, and through the second axial end 24*b*.

Figure 6:
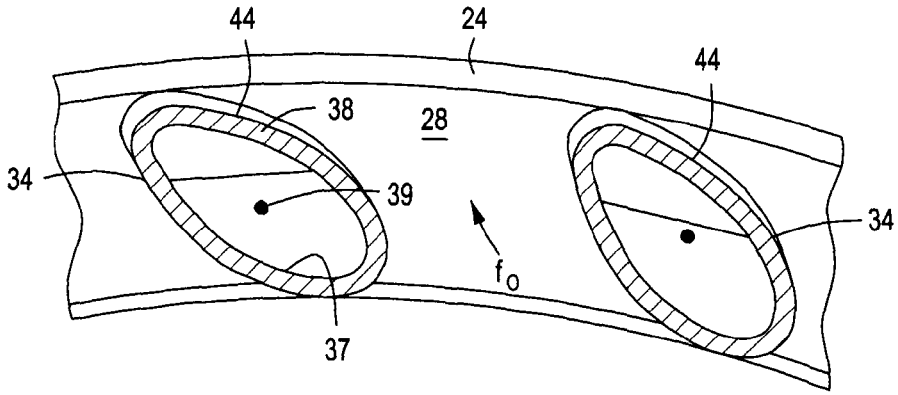
FIG. 6 illustrates a broken-away, enlarged view of a portion of FIG. 4, in accordance with the disclosure.

FIG. 6 illustrates a raised perspective view of a portion of the exemplary embodiment of the channeling body 24 shown in FIG. 4, illustrating two circumferentially adjacent tubular body sections 34. As shown, the tubular body sections 34 may have enclosed sidewalls 38, defining the central bores 37 on the inside and defining exterior surfaces 44 on the outside. The exemplary tubular body sections 34, having the central bores 37, each define an axis 39 extending therein, which is described in greater detail with reference to FIG. 7. The shown exemplary embodiment of the radial outlet channel 28 is bounded by adjacent tubular body sections 34, and more particularly, is bounded by the exterior surfaces 44 of the adjacent tubular body sections 34. While the tubular body sections 34 may be elongated as described with reference to FIG. 4, they may, however, produce the exemplary radial outlet channels 28 each having a cross section which is substantially rectangular. This can also be appreciated from radial views of the fluid channeling device 10 showing rectangular radial outlet channels 28, such as FIGS. 3 and 5. In an exemplary embodiment, the remaining radial outlet channels 28 are substantially similarly disposed around the channeling body 24, as can be appreciated from FIG. 4; however, departures from this arrangement, are contemplated herein.

Figure 7:
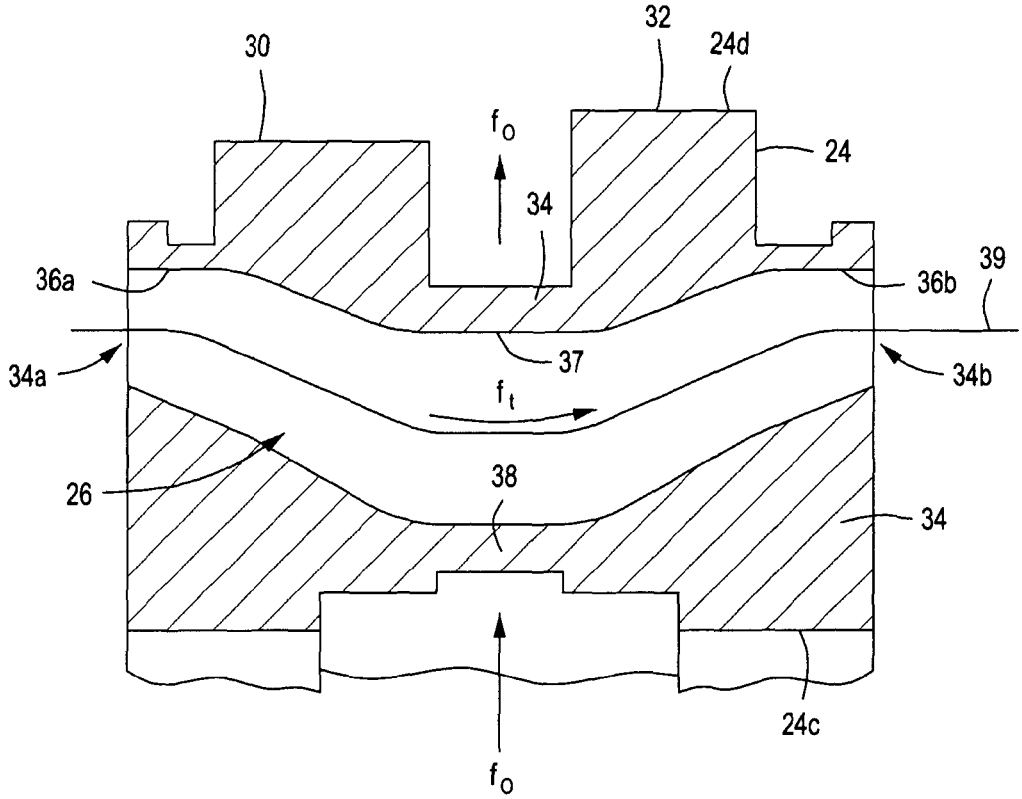
FIG. 7 illustrates a broken-away, enlarged view of a portion of FIG. 5, in accordance with the disclosure.

FIG. 7 illustrates an enlarged view of a portion of FIG. 5, illustrating an exemplary embodiment of one of the axial transfer channels 26 extending through the channeling body 24. The illustrated exemplary embodiment of the axial transfer channel 26 includes one of the tubular body sections 34, which has the enclosed sidewall 38, and the central axis 39 extending longitudinally through the central bore 37. As described above, the tubular body section 34 may extend between the first and second annular body sections 30, 32. Further, the tubular body section 34 may have the first and second open ends 34*a*, 34*b*, which are disposed in the first and second openings 36*a*, 36*b*. The tubular body section 34 may be disposed between the inner circumferential side 24*c* and the outer circumferential side 24*d* and may extend partially or completely therebetween. The central axis 39 may be axially straight, or may be curved, as shown. The axial transfer channel 26 thus may extend through the first opening 36*a* on the first annular body section 30, into the tubular body section 34 via the first open end 34*a*. The axial transfer channel 26 may further extend along the central bore 37, and through the second annular body section 32 via the second open end 34*b* and the second opening 36*b*. In exemplary embodiments having multiple tubular body sections 34, the tubular body sections 34 may have a substantially similar structure to that just described.

Referring again to FIG. 1, the compressor 12 includes first and second flow passages 50, 52 that are defined within the casing 14 and may cross or intersect to define a generally annular channel 54, which may also be described as a generally annular passage intersection. The first flow passage 50 may direct fluid through the outlet 16*b* of the first compression assembly 16 to the inlet 18*a* of the second compression assembly 18. The second flow passage 52 may direct fluid through the outlet 18*b* of the second compression assembly 18 to the outlet 15 of the casing 14. The channeling body 24 may be disposable within the generally annular channel 54.

In an exemplary embodiment, the compressor assembly 12 also includes first and second cylindrical members 62, 64 that are disposed within the interior chamber $C_C$ and are spaced axially apart so that they may define a generally radial section 58 of the second flow passage 52. Each of the first and second cylindrical members 62, 64 has an outer circumferential surface 63, 65, respectively, which may together at least partially define an annular section 56 of the first flow passage 50. Further, the first and second cylindrical members 62, 64 may have axial ends 62*a*, 64*a*, which may also be described as facing ends, The channeling body 24 may be disposable between the first and second cylindrical members 62, 64, and may partially overlap or extend about the first and second cylindrical members 62, 64. In an exemplary embodiment, the first cylindrical member 62 is configured to receive a seal assembly (not shown) or other compressor hardware (e.g., a bearing assembly or the like, not shown) and the second cylindrical member 64 may be a casing for enclosing the second compression assembly 18.

Further, the compressor 12 may include first and second outer sleeve members 66, 68, which may each be disposed about a separate one of the first and second cylindrical members 62, 64, respectively, such that the first flow passage 50 may be at least partially defined. The compressor assembly 12 also includes a shaft 90 that may extend centrally through the casing 14. Each of the first and second compression assemblies 16, 18 includes at least one impeller 92 mounted upon the shaft 90. In an exemplary embodiment, one of the impellers 92 may be a final stage impeller 92*b* that may provide the outlet 16*b* of the first compression assembly 16 and may be fluidly coupled with the first flow passage 50. Further, another one of the impellers 92 may be a first stage impeller 92*a* that may provide the inlet 18*a* of the second compression assembly 18. The second compression assembly 18 may also include a volute providing at the outlet 18*b*. The volute may be configured to discharge fluid from the second compression assembly 18 into the second flow passage 52.

Figure 8:
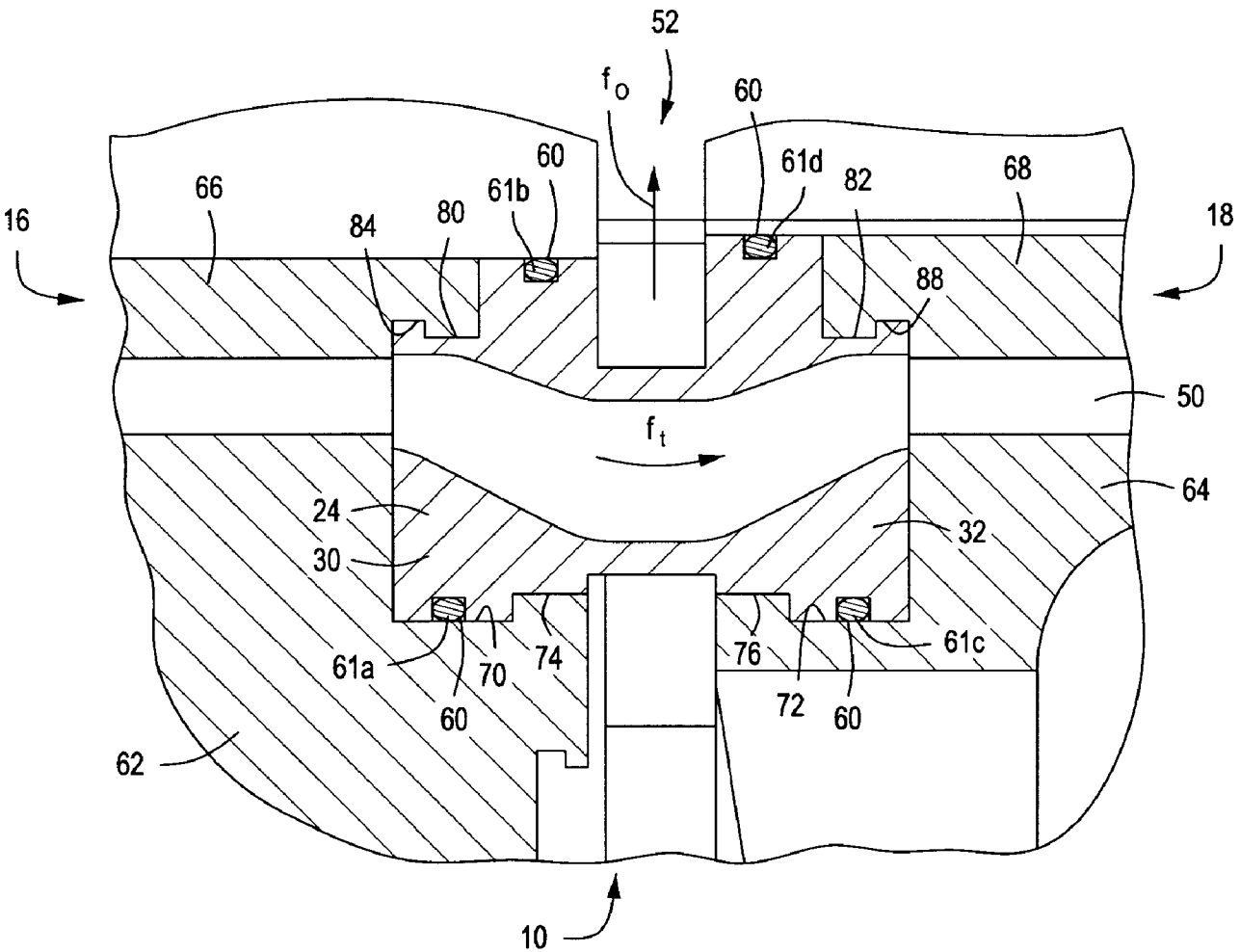
FIG. 8 illustrates a broken-away, enlarged view of a portion of FIG. 1, in accordance with the disclosure.

FIG. 8 illustrates an enlarged view of a portion of FIG. 1, showing an exemplary embodiment of a portion of the channeling body 24, which may be interlocked between the first and second compressor assemblies 16, 18. More particularly, the first cylindrical member 62 may include a shoulder 74, and the first annular body section 30 may include a complementary shoulder 70, with the shoulder 74 engaging the complementary shoulder 70. Similarly, the second cylindrical member 64 may include a shoulder 76, and the second annular body section 32 may include a complementary shoulder 72, with the shoulder 76 engaging the complementary shoulder 72. Together, the shoulders 70, 72, 74, 76 may thusly interlock to substantially prevent axial or radial displacement of the channeling body 24.

Additionally, the first annular body section 30 may be at least partially disposed in the first outer sleeve member 66, and the second annular body section 32 may be at least partially disposed in the second outer sleeve member 68, and, further, the first and second annular body sections 30, 32 may be interlocked therein. More particularly, the first outer sleeve member 66 may include a shoulder 80, and the first annular body section 30 may include a complementary shoulder 84, with the shoulder 80 engaging the complementary shoulder 84. Likewise, the second outer sleeve member 68 may include a shoulder 82, and the second annular body section 32 may include a complementary shoulder 88, with the shoulder 82 engaging the complementary shoulder 88. Together, the shoulders 80, 82, 84, 88, may thusly interlock to substantially prevent axial or radial displacement of the channeling body 24.

In an exemplary embodiment, the fluid channeling device 10 also includes at least one sealing member 60, and, as shown, the fluid channeling device 10 may include four sealing members 60. The four sealing members 60 may be a first sealing member 61*a* disposed between the first annular body section 30 and the first cylindrical member 62, a second sealing member 61*b* disposed between the first annular body section 30 and the first outer sleeve member 66, a third sealing member 61*c* disposed between second annular body section 32 and the second cylindrical member 64, and a fourth sealing member 61*d* disposed between the second annular body section 32 and the second outer sleeve member 68. Accordingly, the four sealing members 61*a-d* (collectively 60) may seal any clearance to substantially prevent flow from the first flow passage 50 into the second flow passage 52, and vice versa. Further, each sealing member 60 may be elastomeric, and may be provided by a commercially available "O-ring."

Figure 9:
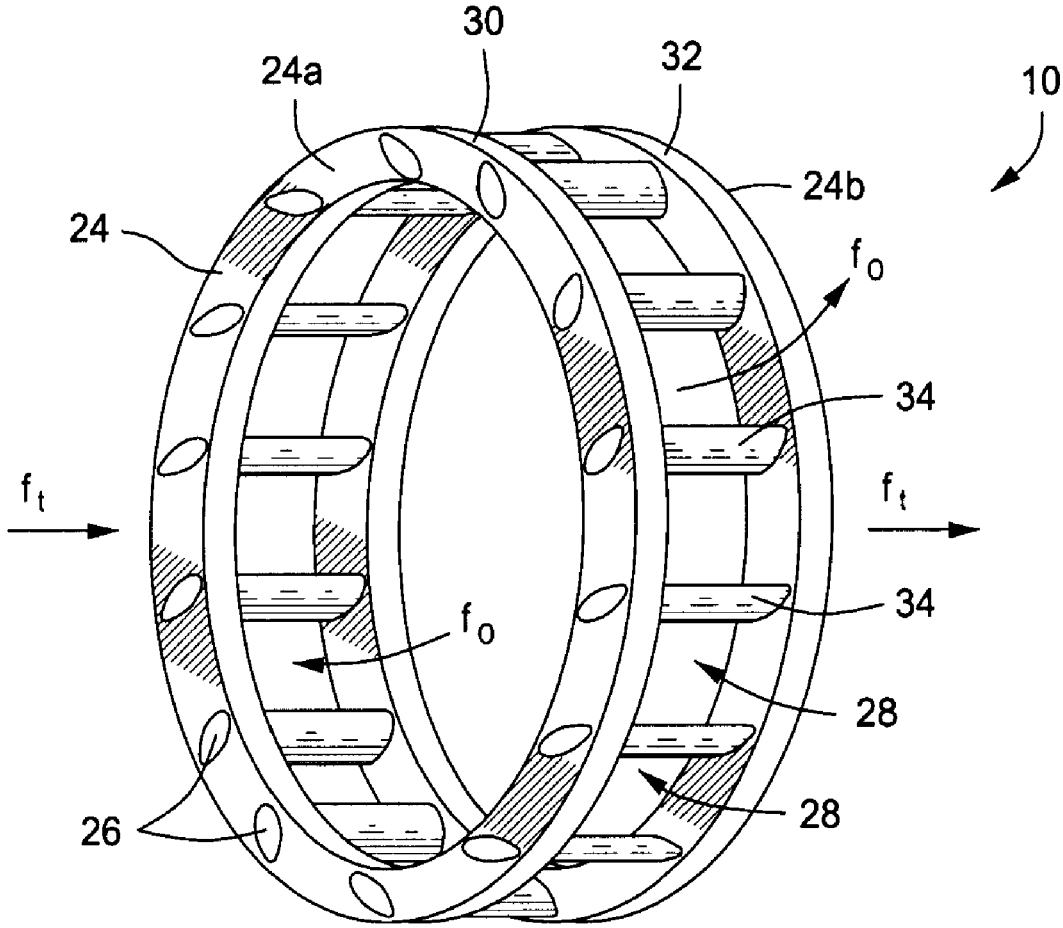
FIG. 9 illustrates an isometric view of an exemplary embodiment of a fluid channeling device in accordance with the disclosure.

FIG. 9 illustrates an isometric view of an exemplary embodiment of the fluid channeling device 10. As shown, the fluid channeling device 10 includes the channeling body 24, which may include the first and second annular body sections 30, 32. The first and second axial ends 24*a*, 24*b*, may define the axial extents of the channeling body 24, and the first and second annular body sections 30, 32 may be aligned and spaced apart axially, with the tubular body sections 34 extending therebetween. The axial transfer channels 26 may extend axially through the channeling body 24, as described with reference to FIG. 7. Further, the radial outlet channels 28 may extend radially through the channeling body 24, possibly between adjacent tubular body sections 34, as described with reference to FIGS. 3 and 4.

Referring to FIGS. 1 and 5-9, the fluid channeling device 10 operates to channel two flows of fluid through the channeling body 24, allowing the flows to traverse the annular channel 54, while substantially preventing intermixing. The first flow is an axial transfer flow $f_t$, which begins in the first compression assembly 16, and flows to the second compression assembly 18. The second flow is the radial outlet flow $f_O$, which flows from the outlet of the second compression assembly 18 through the outlet 15 of the casing 14. The axial transfer flow $f_t$ may traverse the region between the first and second compressor assemblies 16, 18 through the axial transfer channels 26, which have been described in detail above. The radial outlet flow $f_O$ may travel through the radial outlet channels 28, possibly between the tubular body sections 34. Thus, it can be seen that the radial outlet flow $f_O$ and the axial transfer flow $f_t$ may travel through the channeling body 24 in orthogonal directions, but since the fluid channeling device 10 may be configured to sealingly channel the two fluid flows $f_t$, $f_O$ therein, the fluid flows $f_t$, $f_O$ may be prevented from substantially intermixing, without necessitating additional perforations in the casing 14 of the compressor 12.

The foregoing has outlined features of several embodiments so that those skilled in the art is better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. A compressor comprising: a casing having an interior chamber, a central axis extending through the interior chamber, and an outlet; first and second compression assemblies disposed in the interior chamber, spaced axially apart along the central axis, wherein each of the first and second compression assemblies has an inlet, an outlet, and at least one compressor stage including an impeller; and a fluid channeling device including a channeling body disposable in the interior chamber, axial transfer channels configured to fluidly couple the outlet of the first compression assembly with the inlet of the second compression assembly, and radial outlet channels configured to fluidly couple the outlet of the outlet of the second compression assembly with the outlet of the casing; and a first flow passage defined in the casing, disposed between and configured to fluidly couple the outlet of the first compression assembly with the inlet of the second compression assembly, and including an annular section extending axially along the central axis of the casing; and a second flow passage defined in the casing, disposed between and configured to fluidly couple the outlet of the second compression assembly with the outlet of the casing, and including a radial section extending perpendicularly to and through the first flow passage such that the first and second flow passages commonly include an annular channel, wherein the channeling body is annular, disposable in the annular channel, and configured to prevent substantial fluid flow between the first and second flow passages.

2. The compressor of claim 1, further comprising first and second cylindrical members spaced axially apart to axially define the annular channel, wherein the channeling body is disposable between the first and second cylindrical members.

3. The compressor of claim 2, wherein:

the first compression assembly includes a first outer sleeve member disposed around the first cylindrical member;

the second compression assembly includes a second outer sleeve member disposed around the second cylindrical member; and the channeling body includes first and second annular body sections spaced apart along the central axis and tubular body sections extending between the first and second annular body sections and spaced apart circumferentially, wherein the first annular body section is disposable at least partially in the first outer sleeve member and the second annular body section is disposable at least partially in the second outer sleeve member.

4. The compressor of claim 3, wherein the radial outlet channels are axially defined between the first and second annular body sections and radially defined between adjacent tubular body sections.

5. The compressor of claim 3, wherein:

each one of the tubular body sections includes a central bore, a first open end and a second open end;

the first annular body section includes first openings;

the second annular body section includes second openings;

the first open end of each one of the tubular body sections is disposed in one of the first openings and the second open end of each one of the tubular body sections is disposed in one of the second openings; and the axial transfer channels extend from the outlet of the first compression assembly, through the first annular body section, through the first openings, through the tubular body sections, through the second openings, through the second annular body section, and to the inlet of the second compression assembly.

6. The compressor as recited in claim 2, wherein a central bore is defined through the channeling body, wherein the radial outlet channels extend from the central bore, radially through the channeling body, and to the outlet of the casing.

* * * * *